US009119470B2

(12) United States Patent
Kreyenkamp et al.

(10) Patent No.: US 9,119,470 B2
(45) Date of Patent: Sep. 1, 2015

(54) FITTING FOR CORNER CABINETS AND PULL-IN DEVICE FOR SAID TYPE OF FITTING

(75) Inventors: Reiner Kreyenkamp, Bad Essen (DE); Dietmar Baro, Berlin (DE); Arthur Wolf, Bad Essen (DE)

(73) Assignee: Kesseböhmer Holding e.K., Bad Essen (DE)

( * ) Notice: Subject to any disclaimer, the term of this patent is extended or adjusted under 35 U.S.C. 154(b) by 46 days.

(21) Appl. No.: 14/119,531

(22) PCT Filed: May 23, 2011

(86) PCT No.: PCT/EP2011/002548

§ 371 (c)(1), (2), (4) Date: Feb. 16, 2014

(87) PCT Pub. No.: WO2012/159641

PCT Pub. Date: Nov. 29, 2012

(65) Prior Publication Data

US 2014/0225492 A1 Aug. 14, 2014

(51) Int. Cl.

| | |
|---|---|
| ***A47B 95/00*** | (2006.01) |
| ***A47B 96/02*** | (2006.01) |
| ***A47B 81/00*** | (2006.01) |

(52) U.S. Cl.

CPC ..... *A47B 96/025* (2013.01); *A47B 81/002* (2013.01); *A47B 96/024* (2013.01)

(58) Field of Classification Search

CPC .. A47B 96/025; A47B 81/002; A47B 96/024; A47B 49/006; A47B 49/00; A47B 88/34; A47B 88/345; A47B 88/465; A47B 88/458; A47B 88/35; A47B 88/047

USPC ..... 312/238, 307, 322, 132, 319.2; 108/137, 140, 143

See application file for complete search history.

(56) References Cited

U.S. PATENT DOCUMENTS

| | | | | | |
|---|---|---|---|---|---|
| 2,698,776 | A | * | 1/1955 | Stoeckl | 312/238 |
| 3,160,453 | A | * | 12/1964 | Tassell | 312/238 |
| 4,582,372 | A | * | 4/1986 | Cooper | 312/322 |
| 4,639,051 | A | * | 1/1987 | DeBruyn | 312/275 |
| 4,832,300 | A | * | 5/1989 | Twellmann | 248/240.1 |
| 4,917,446 | A | * | 4/1990 | Mariani | 312/325 |

(Continued)

FOREIGN PATENT DOCUMENTS

| | | |
|---|---|---|
| DE | 20 2004 011 200 U1 | 1/2006 |
| DE | 20 2005 016 432 U1 | 1/2006 |

(Continued)

*Primary Examiner* — Janet M Wilkens
(74) *Attorney, Agent, or Firm* — Gudrun E. Huckett

(57) ABSTRACT

A corner cabinet fitting has a support with a guide member supporting a shelf in the cabinet interior for transferring the shelf from an inner position in the cabinet interior into an outer position. The guide member has a first end articulated by a guide member joint axis on the shelf bottom and a second end connected pivotably by a support fitting with a corner cabinet part. During closing, a pull-in device associated with shelf and guide member automatically pulls in shelf and guide member into the cabinet interior from a defined intermediate pivoted shelf position onward. The pull-in device is supported solely on the guide member or the shelf in coaxially alignment with the guide member joint axis on the shelf bottom. An actuator, connected to the pull-in-device and movable relative to the guide member, interacts with a driver on the shelf or on the guide member.

12 Claims, 6 Drawing Sheets

(56) References Cited

U.S. PATENT DOCUMENTS

| | | | | |
|---|---|---|---|---|
| 2006/0012273 | A1 | 1/2006 | Kreyenkamp | |
| 2007/0262682 | A1 * | 11/2007 | Gunter | 312/238 |
| 2010/0084952 | A1 * | 4/2010 | Sagel | 312/238 |
| 2011/0193455 | A1 | 8/2011 | Kreyenkamp et al. | |
| 2011/0193456 | A1 * | 8/2011 | Kreyenkamp et al. | 312/238 |

FOREIGN PATENT DOCUMENTS

| | | | |
|---|---|---|---|
| DE | 20 2006 018 725 | U1 | 4/2008 |
| DE | 20 2010 002 232 | U1 | 5/2010 |
| DE | 202010017933 | * | 3/2013 |
| EP | 102006035157 | * | 4/2007 |
| EP | 1925237 | * | 5/2008 |
| EP | 1925238 | * | 5/2008 |
| EP | 1925239 | * | 5/2008 |
| EP | 2191745 | * | 11/2008 |
| EP | 2064971 | * | 6/2009 |
| EP | 2092850 | * | 8/2009 |
| EP | 2174568 | * | 4/2010 |
| EP | 2 353 438 | A2 | 8/2011 |
| EP | 2353436 | * | 8/2011 |

* cited by examiner 1
2
3
4
5
6
11
12
13
14
15
16
17
18
20
21
12-3

FITTING FOR CORNER CABINETS AND PULL-IN DEVICE FOR SAID TYPE OF FITTING

BACKGROUND OF THE INVENTION

The invention concerns a fitting for corner cabinets, in particular for kitchen corner cabinets, comprising an interior that is accessible by means of a corner cabinet door at the front side and is substantially rectangular in horizontal section, comprised of at least one support stationarily supportable in the interior of the corner cabinet for securing at least one one-part shelf of a basic shape that is similar to a semicircle, wherein the support has at least one guide member that supports the shelf in an articulated manner and transfers the shelf on a predetermined movement path from an inner position in the interior of the corner cabinet into an outer position that is substantially located in front of the door opening of the corner cabinet, wherein the guide member is articulated by means of a guide member joint axle on the bottom side of the shelf and is connected pivotably by means of a support fitting with a corner cabinet part, in particular a sidewall part, wherein a pull-in device is associated with the shelf and its guide member for an automatic pulling-in action of the shelf and the guide member into the interior of the corner cabinet, from a defined intermediate pivot position of the shelf on, during the course of a closing movement A fitting for corner cabinets is disclosed, for example, in DE 20 2004 011 200 U1. This fitting has a support with two guide members controlled a predetermined movement path of the shelf wherein one guide member is supported in one area of the corner cabinet in a pivotable way and another one is supported on another area of the corner cabinet. The two guide members are articulated on the bottom side of each shelf so that they ensure that the shelf is movably supported such that not only a pivot movement about an axis can be performed but moreover the shelf can perform also an additional movement relative to a circular movement path which makes it possible that, as a result of this movement path controlled by the two guide members, a final position can be assumed in which the shelf is positioned for the most part in front of the door opening of the corner cabinet.

It is particularly advantageous in this context that also in case that several shelves are provided that are positioned at a spacing above each other, as a result of the individual guide members associated with each shelf, the shelves can also be individually pivoted outwardly without the other provided shelves having to be mandatorily entrained. In this connection, each shelf support surface is accessible from above for the user.

DE 20 2005 016 432 discloses a pivotable pull-out device for a corner cabinet that, in analogy to the fitting system disclosed in the afore mentioned document, operates with two guide members, wherein one is attached to a sidewall of the cabinet and another to a vertical support column. Due to the two provided guide members, it is also possible in this system to transfer a shelf for the most part to a position in front of the door opening. As a result of a support arm-like construction provided thereat, two shelves that are arranged above each other can only be moved together into the outer position located in front of the door opening so that the lower shelf positioned underneath the upper shelf is no longer freely accessible from above.

Since the fittings that are known from the two documents each have shelves that, due to the movement path controlled by the guide members, can be transferred into an end position in which the shelves are for the most part positioned in front of the door opening of the corner cabinet, a large closing movement of the shelves must thus be performed. In practical use, this leads often to an operating person returning the shelves with a powerful movement into the cabinet which may cause the objects supported on the shelves to fall over and to impair free movability of the shelves in a subsequent opening movement.

Therefore, DE 20 2006 018 725 U discloses a fitting for shelves such as furniture shelves of pieces of furniture with a support that is pivotable between two end positions about an axis fast with the body of the piece of furniture. Its closing movement is provided an automatic pull-in mechanism for the support in at least one of its end positions. For this purpose, an angle lever is provided with a spring which upon surpassing a dead center position pivots the angle lever farther in clockwise direction and thereby entrains the driver positioned on the shelf. This angle lever is supported on the central support which is pivotable between the two end positions about the axis fast with the body of the piece of furniture so that this automatic pull-in mechanism is not capable of being installed where such a central support is not provided. Moreover, this automatic pull-in mechanism has an extremely complex configuration and cannot be retrofitted afterwards on a fitting for corner cabinets.

It is the object of the present invention to further develop a fitting for corner cabinets of the aforementioned kind such that, while maintaining the advantageous support of the shelf by means of a guide member and the possibility to position the shelf for the most part in front of the door opening in an end position, the closing movement can be performed in a controlled fashion by a pull-in device wherein the pull-in device is to be of a simple configuration and is to be retrofitted also for shelves provided with guide members of fittings for corner cabinets.

SUMMARY OF THE INVENTION

As a solution to this object, the fitting of the aforementioned kind is characterized in that the pull-in device is supported solely on the guide bar or solely on the shelf with a joint axis that is aligned coaxial to the guide member joint axis on the bottom side of the shelf and comprises an actuator which is movable relative to the guide bar and interacts with a driver provided on the shelf or on the guide member.

In this way, a fitting for corner cabinets is made available which is provided with a pull-in device that is of an extremely simple configuration and can also be installed with only a few manipulations on already existing guide members of fittings for corner cabinets because it is solely supported on this guide member and therefore requires no other components that are to be connected to other support columns or the like. Due to the relative movability of the actuator of the pull-in device that is supported, in turn, during its relative movement on the guide member, a pull-in movement can be exerted by means of the driver on the shelf and causes at the same time the guide member itself and therefore also the pull-in device to move into their closed position. This is possible because the pull-in device itself has a joint axis that is coaxially aligned to the guide member joint axis of the guide member at the bottom side of the shelf and, by means of the driver on the shelf, exerts a closing force on the shelf by which the shelf is pivoted about this axis and thus at the same time, as a result of the controlled movement of the guide member, the closing force of the actuator is exerted transferred onto the shelf and the guide member.

Preferably, the actuator is pivotably provided on the pull-in device that is stationarily connected to the guide member, namely by means of a pivot axis which has a positional spacing to the joint axis of the pull-in device and to the guide member joint axis of the guide member. The actuator can be designed expediently as a pivot pawl that in turn has a guide slot that is engaged by a driver provided on the bottom side of the shelf, for example, in the form of a pin or a bolt-shaped driver.

In a particularly advantageous embodiment, the pull-in device as a whole is provided with a holder which engages about a section of the guide member, namely with oppositely positioned support surfaces, namely preferably in such a way that it can be clipped onto the guide member. Accordingly, the pull-in device as a whole is a part that is to be provided without a tool on the guide member so that, with only a few manipulations, it can be retrofitted later, even by an inexperienced user, on guide members of existing fittings of the kind of interest in this context.

Preferably, as described at the beginning, the shelf is of course provided with two guide members in order to realize the controlled movement of the shelf from the closed position into a open position in which the shelf, accessible from above, is positioned for the most part in front of the front surface of a piece of furniture. In this context, the pull-in device is to be provided on only one of the two guide members. The positional distances of the guide member joint axis and of the joint axis as well as the configuration of the guide slot are to matched to this controlled movement, likewise the position of the driver at the bottom side of the shelf, in order to ensure that, for example, from a door opening position of 60° on, the driver during the course of a closing movement engages the actuator during the course of a closing movement whereupon the pull-in device takes over the further closing movement of the shelf. In this context, an additional driver can be provided also on the door in order to transfer the door itself also automatically into the closed position at the same time. In reverse, the additional drive can entrain the shelf or the shelves when the door is opened.

BRIEF DESCRIPTION OF THE DRAWINGS

Further advantageous embodiments of the invention result from the further dependent claims, the following description, and the drawing.

The drawings show in.

In the drawing, parts that are principally acting the same are identified with same reference characters.

DESCRIPTION OF PREFERRED EMBODIMENTS

Figure 10:
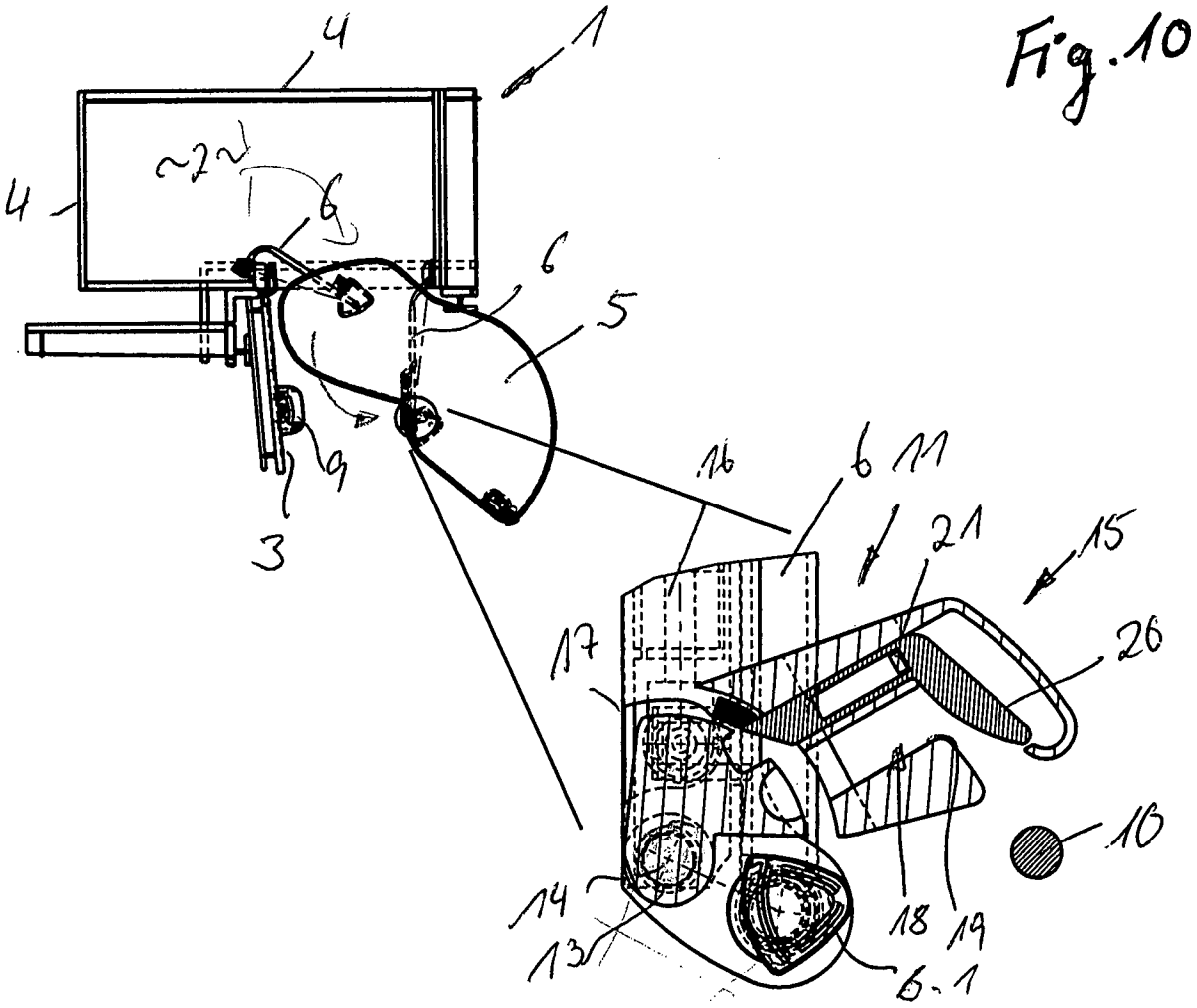

In general, 1 identifies in the drawing a kitchen corner cabinet with a substantially rectangular interior 2 that is accessible by a door 3. The interior 2 is delimited by sidewalls 4. In the interior 2 of the corner cabinet 1, shelves 5 are to be accommodated on top of each other which are supported on guide members 6. These guide members 6 engage from below a shelf 5, respectively, and have at the end guide member eyes 6.1 that are engaged by appropriate bolt-shaped connectors 7 of the shelf 5. The guide members 6 of a shelf 5 are pivotably connected to sidewalls 4 of the corner cabinet 1, respectively, and perform together a controlled movement in order to pivot a shelf out of the position illustrated in FIG. 7 into the position illustrated in FIG. 10 in which a shelf 5 is substantially positioned in front of the corner cabinet 1 and the shelf 5 is accessible from above. In other respects, the corner cabinet with the fitting corresponds substantially to the fitting of the applicant that is known from DE 20 2004 011 200 U1.

Figure 1:
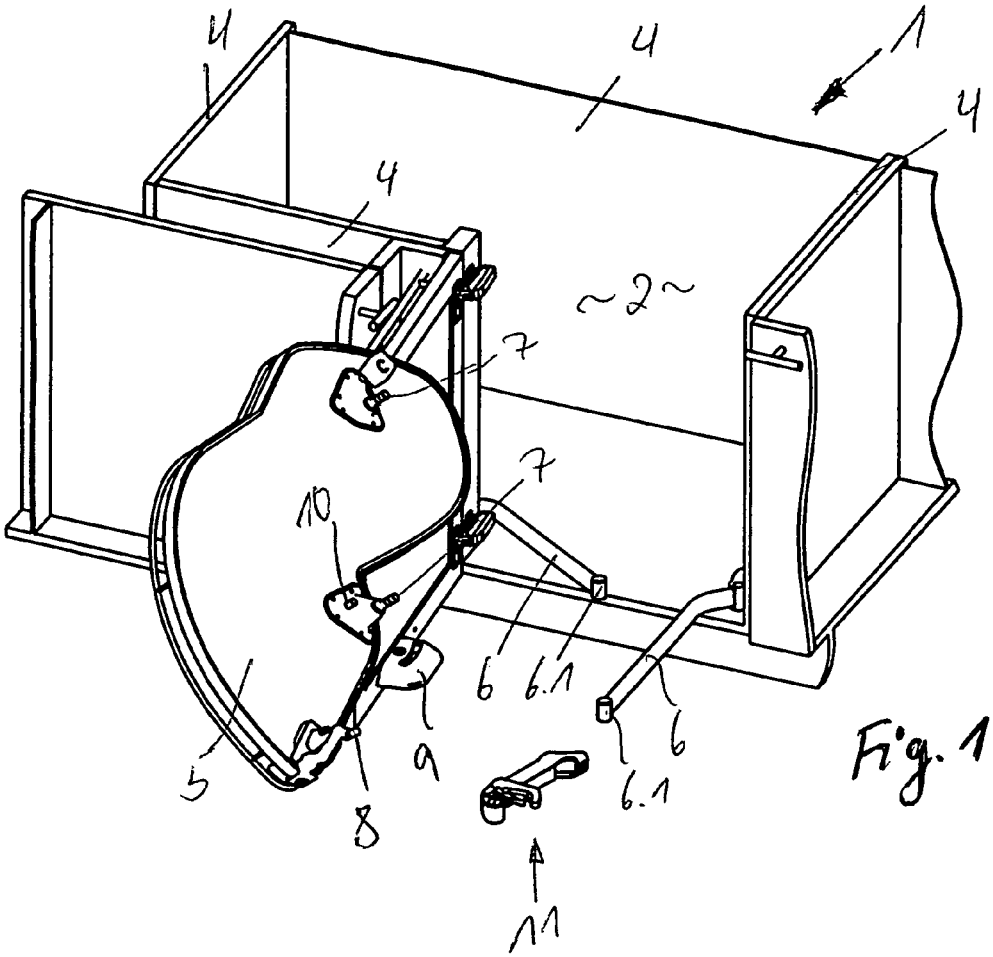
FIG. 1 an embodiment of a corner cabinet with an embodiment of a fitting according to the present invention with a shelf folded for illustrating purposes about a horizontal axis for illustrating the bottom side of the shelf in only partially mounted state of the parts.

FIG. 1 shows the shelf 5 in a position which it does not assume in practice. Instead, the shelf has been pivoted in the drawing in counterclockwise direction in order to show its bottom side with the bolt-shaped connectors 7, a pin 8 for a door driver 9, as well as a driver 10 for a pull-in device generally identified by 11 which is shown in FIG. 1 in not yet mounted state.

Figure 2:
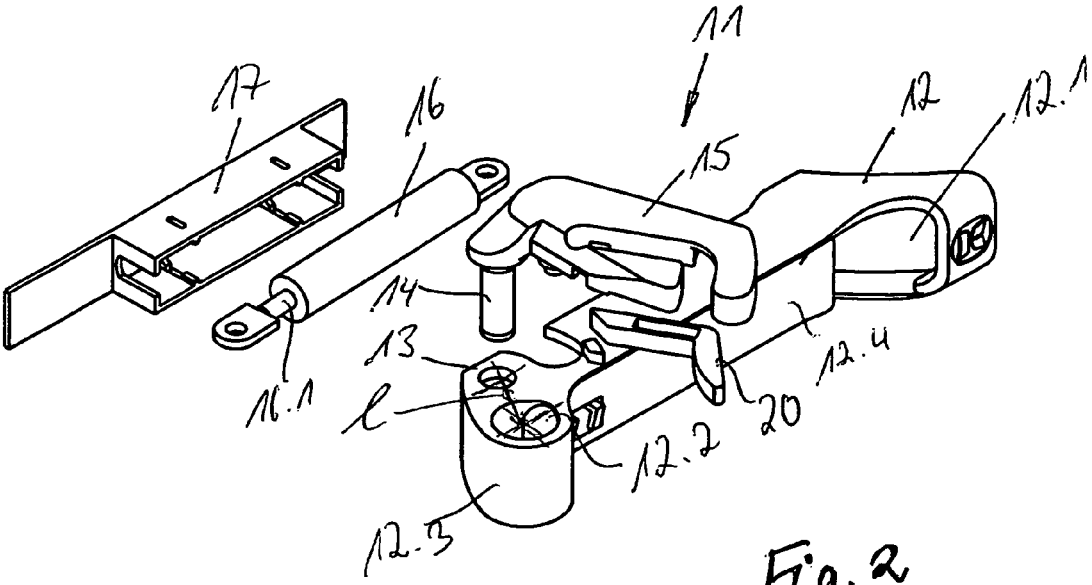
FIG. 2 in an assembly illustration an embodiment of a pull-in device of a fitting according to the invention.

This pull-in device 11 is illustrated in more detail with the individual parts in FIG. 2. The pull-in device 11 has first a holder 12, for example, of plastic material with a through opening and a second through opening 12.2 and an integral part 12.3 for the guide member eye 6.1 of the guide member 6. The guide member 6 to the right in FIG. 1 is to be threaded with its guide member eye 6.1 into the opening 12.1 of the holder 12 and to be inserted through the opening 12.2 into the integral eye part 12.3 of the holder 12 whereupon the holder 12 and thus the pull-in device 11 as a whole are to be clipped onto the guide member 6 in its forward area. This can be done without tools and can also be retrofitted onto guide members 6 of conventional fittings.

The vertical pivot axis of the guide member 6 (guide member joint axis) correlated with the shelf 5 is thus coaxially arranged relative to the joint axis of the pull-in device 11 because the pull-in device 11, due to the stationary arrangement of the pull-in device 11 at the forward area of the guide member, has an identical pivot axis in relation to the shelf 5. The holder 12 of the pull-in device 11 is supported therefore with the inner surfaces of the opening 12.1 and the opening 12.2 or the inner surfaces of the integral eye part 12.3 as well as the surface 12.4 on the guide member 6 and the guide member eye 6.1. At a bearing spacing I, a further opening 13 is provided on the holder 12 of the pull-in device 11 that is engaged in the mounted state by a joint bolt 14 of an actuator 15 embodied as a pivot pawl.

This actuator 15 is loaded by a gas pressure spring 16 which has an extendable piston 16.1 and by means of which the actuator 15 (pivot pawl) upon appropriate activation is to be moved, i.e., pivoted. In the mounted state, the gas pressure spring 16 is positioned within a housing 17 and supported therein which rearwardly closes off the holder 12.

Figure 3:
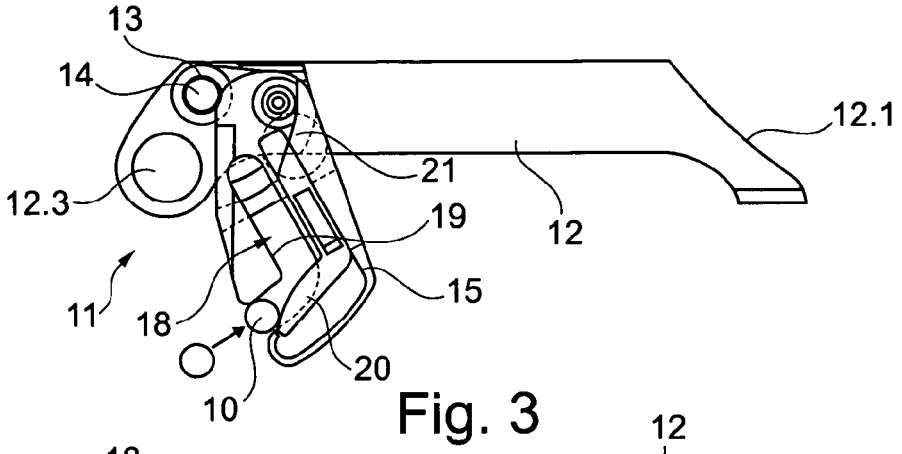
FIGS. 3, 4, 5, and 6 plan views, respectively, of an embodiment of a pull-in device according to the invention according to the embodiment of FIG. 2 in different states from the delivery state through the subsequent closing process up to the closed cabinet.
Figure 4:
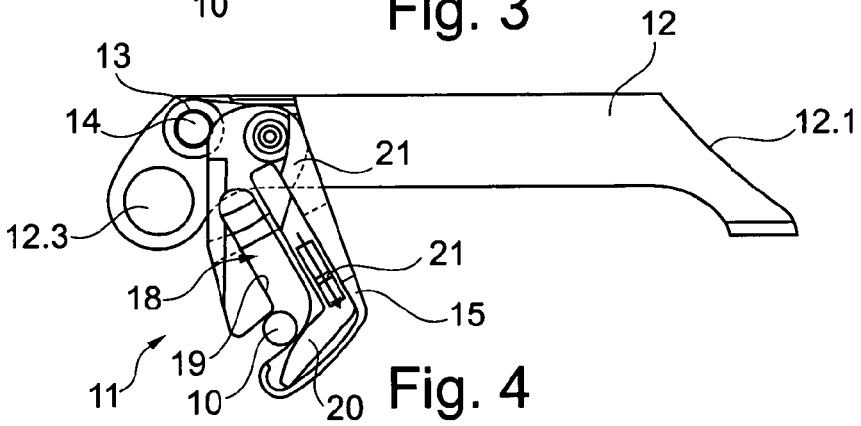
Figure 5:
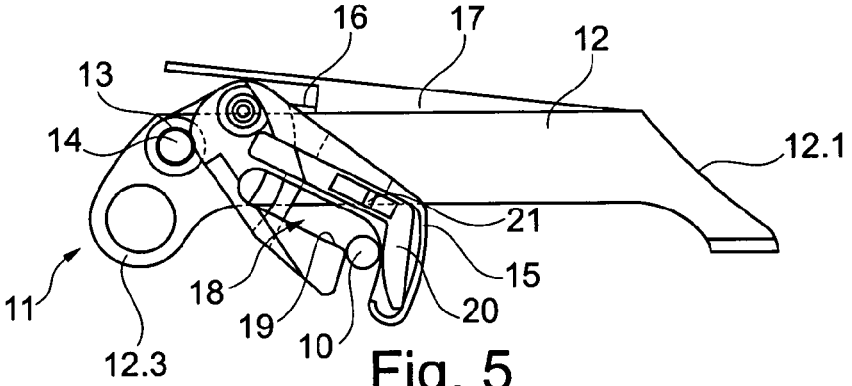

In FIGS. 3 to 6 the pull-in device is shown in various operating positions. In FIG. 3 the state is shown in the delivery state of the pull-in device 11. The actuator 15 is in an angled position. Within the actuator 15 a guide slot 18 with a curved guide path 19 is provided which is governed by a spring-loaded safety element 20. When the spring-loaded safety element 20 is in the position shown in FIG. 3, the driver cannot yet enter the guide path. For this purpose, a safety pin 21 is provided. When upon a closing movement the driver 10 moves into the position illustrated in FIG. 4, the safety element 20 is unlocked, against the force of the provided spring 21, so that the follower 10 can penetrate into the guide path. When it follows the arc during a further closing movement, the actuator is activated so that the gas pressure element 16 is triggered. This causes the rear cover to lift so that the actuator 15 is transferred from the position illustrated in FIG. 5 into the position illustrated in FIG. 6 in which the pull-in device 15 as a whole is automatically transferred with the guide member 6 into the cabinet interior 2 and, in this way, the cabinet was closed by the automatic pull-in action. In this context, the door 3 can also be entrained.

Figure 6:
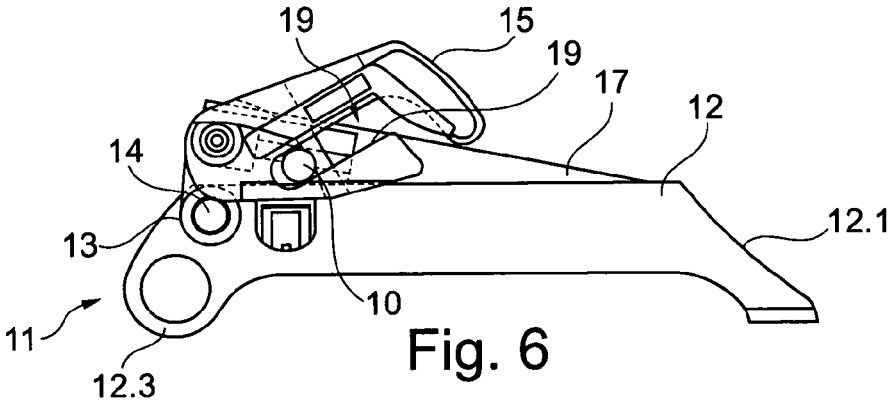
Figure 7:
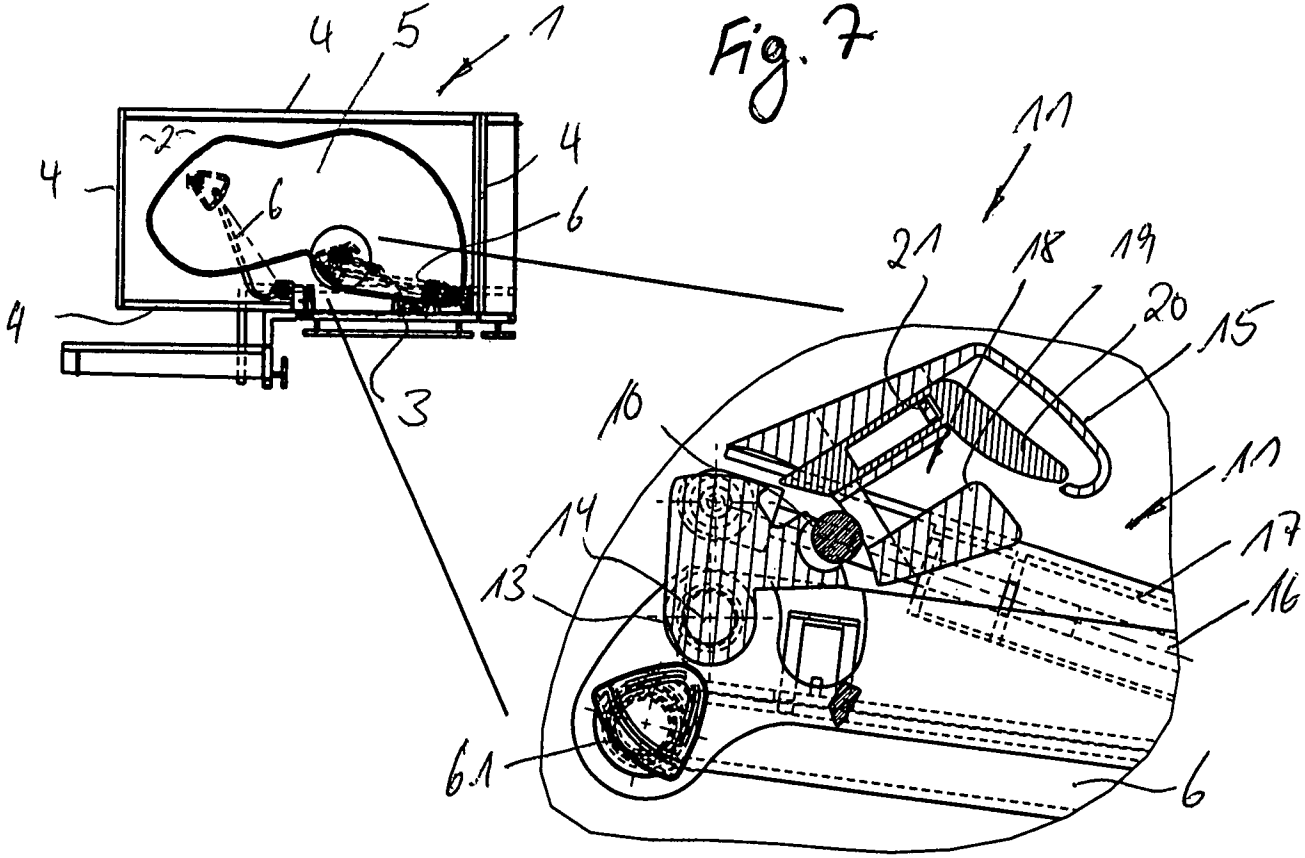
FIGS. 7 to 10 in juxtaposed illustration, respectively, the schematic cross-sectional illustration of a corner cabinet with an embodiment of a fitting according to the invention with the partially sectioned view of the guide member with the pull-in device in the closed state (FIG. 7), in the partially open state (FIG. 8), in the open state of the cabinet door with shelf not yet completely pulled out (FIG. 9), and in the open state with open door and pulled-out shelf FIG. 10.

In FIG. 7, to the left at the top, a cross-sectional illustration (schematic) of the corner cabinet and, to the right adjacent thereto, an enlarged detail view of the area of the guide member 6 with guide member eye 6.1 as well as adapted pull-in device 15 are illustrated, namely in the initial position, i.e., In the position in which the cabinet is closed and the shelf 5 is located within the cabinet interior 2. Shown is that the pull-in device 11 is in the position as illustrated in FIG. 6, wherein the driver 10 is located in the end area of the guide path 18 and the gas pressure spring 16 as well as the cover 17 are oriented in an upwardly slanted position.

Figure 8:
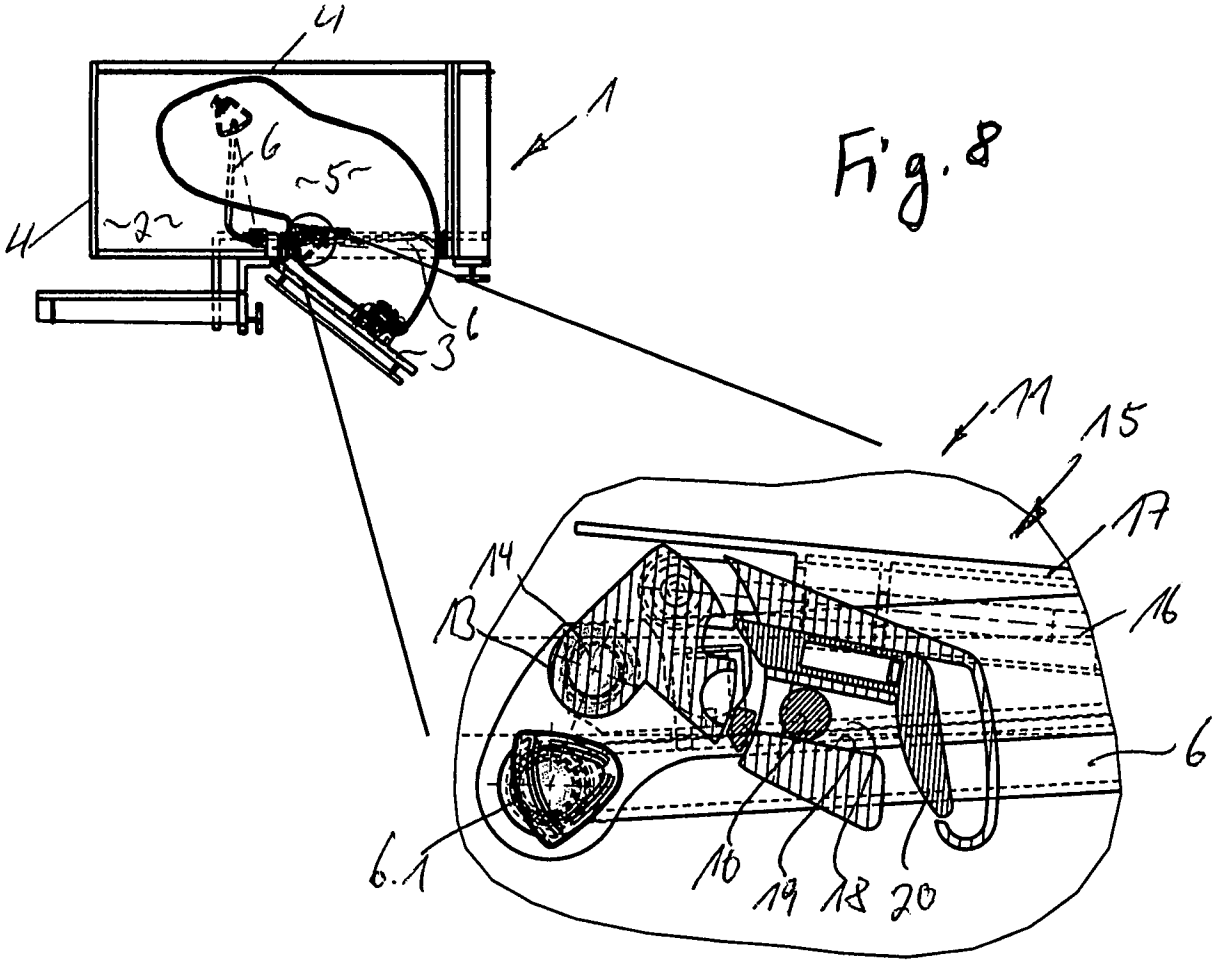
Figure 9:
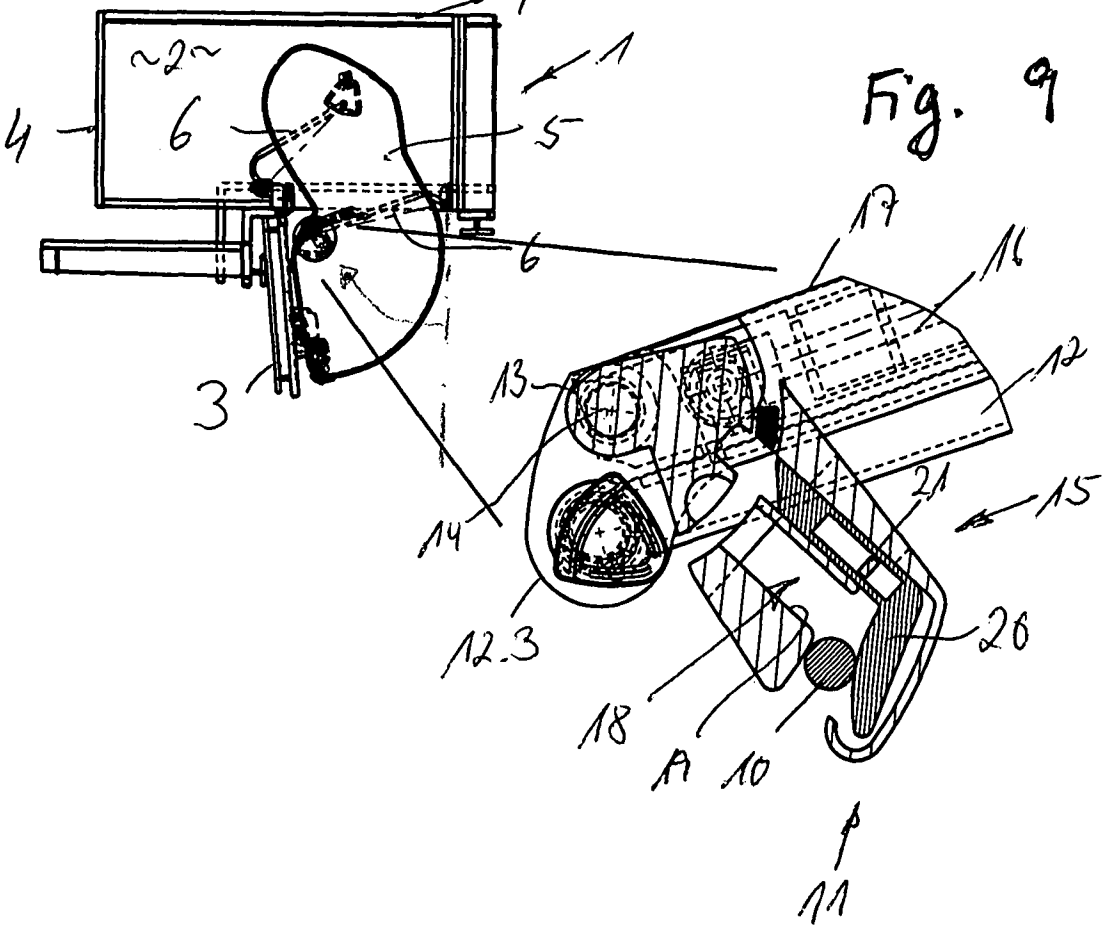

In FIG. 8, in reverse sequence from what has been discussed in FIGS. 3 to 6, the state is shown when the the door 3 is opened. It is shown that the driver 10 is entrained in the guide path 18 and the gas pressure spring 16 lowered together with the cover 17. When the door 3 is opened, as illustrated in FIG. 9, the driver 10 is at the end of the guide path 19 in the guide slot 18. The shelf 5 can now be gripped and pivoted in front of the corner cabinet wherein the driver 10 is moved out of the guide slot 18 and thus out of the guide path 19. When the cabinet is to be closed, the process is reversed from FIG. 10 to FIG. 7 wherein upon a pivot angle of approximately 60°, relative to the open position of the door, the automatic pull-in action begins and the shelf 5 together with the guide member 6 automatically closes.

What is claimed is:

1. A fitting for a corner cabinet that has an interior that is accessible by a corner cabinet door at a front side of the corner cabinet and that is substantially rectangular in horizontal section; the fitting comprising:

a support adapted to be stationarily supported in the interior of the corner cabinet;

a one-part shelf supported on the support;

wherein the support has a guide member that supports the shelf in an articulated manner and transfers the shelf on a predetermined movement path from an inner position in the interior of the corner cabinet into an outer position that is substantially located in front of a door opening of the corner cabinet;

wherein the guide member has a first end that is articulated by a guide member joint axis on a bottom side of the shelf and has a second end that is connected pivotably by a support fitting with a corner cabinet part;

a pull-in device associated with the shelf and the guide member, wherein the pull-in device is adapted to automatically pull in the shelf and the guide member into the interior of the corner cabinet, from a defined intermediate pivot position of the shelf onward, during a closing movement;

wherein the pull-in device is supported solely on the guide member or solely on the shelf with a pivot axis that is coaxially aligned with the guide member joint axis on the bottom side of the shelf;

an actuator operatively connected to the pull-in-device and movable relative to the guide member, wherein the actuator interacts with a driver provided on the shelf or on the guide member;

wherein the actuator is pivotably supported on the pull-in device.

2. The fitting according to claim 1, wherein the actuator has a pivot axis that has a positional spacing relative to the pivot axis of the pull-in device and to the guide member joint axis of the guide member.

3. The fitting according to claim 1, wherein the actuator is a pivot pawl.

4. The fitting according to claim 3, wherein the pull-in device comprises a holder engaging about a section of the guide member.

5. The fitting for corner cabinets according to claim 4, wherein the holder is adapted to be secured without tools on the guide member and comprises oppositely positioned support surfaces that engage about the guide member so as to enclose a guide member eye of the guide member having a central guide member joint axis.

6. The fitting according to claim 5, wherein the holder is adapted to be clipped onto the guide member.

7. The fitting according to claim 1, further comprising a gas pressure spring element that engages the actuator.

8. The fitting according to claim 1, wherein the driver is provided on the shelf and the actuator has a guide slot, wherein the driver engages the guide slot from a predetermined closing position of the shelf onward.

9. The fitting according to claim 8, wherein the actuator has a lockable safety element that is associated with the guide slot.

10. The fitting according to claim 9, wherein the safety element is spring-loaded.

11. The fitting according to claim 9, wherein the safety element secures the guide slot against faulty manual operation.

12. The fitting according to claim 8, wherein the guide slot has a guide path that is embodied with an arc-shaped section.

* * * * *